US010468209B2

(12) United States Patent
Lee

(10) Patent No.: US 10,468,209 B2
(45) Date of Patent: Nov. 5, 2019

(54) WATERPROOF BOARD SWITCH AND METHOD OF MANUFACTURING WATERPROOF BOARD SWITCH

(71) Applicant: Soo Ho Lee, Incheon (KR)

(72) Inventor: Soo Ho Lee, Incheon (KR)

( * ) Notice: Subject to any disclaimer, the term of this patent is extended or adjusted under 35 U.S.C. 154(b) by 0 days.

(21) Appl. No.: 15/309,718

(22) PCT Filed: May 7, 2015

(86) PCT No.: PCT/KR2015/004526
§ 371 (c)(1),
(2) Date: Nov. 8, 2016

(87) PCT Pub. No.: WO2015/170877
PCT Pub. Date: Nov. 12, 2015

(65) Prior Publication Data

US 2017/0148586 A1 May 25, 2017

(30) Foreign Application Priority Data

May 9, 2014 (KR) ..... 10-2014-0055540

(51) Int. Cl.

| | |
|---|---|
| ***H01H 13/06*** | (2006.01) |
| ***H01H 13/48*** | (2006.01) |
| ***H01H 11/04*** | (2006.01) |
| ***H01H 13/14*** | (2006.01) |
| ***H01H 13/36*** | (2006.01) |
| ***H01H 13/52*** | (2006.01) |

(52) U.S. Cl.
CPC ..... *H01H 13/06* (2013.01); *H01H 11/04* (2013.01); *H01H 13/14* (2013.01); *H01H 13/48* (2013.01); *H01H 13/36* (2013.01); *H01H 2013/525* (2013.01); *H01H 2203/038* (2013.01); *H01H 2205/03* (2013.01); *H01H 2215/004* (2013.01); *H01H 2223/002* (2013.01); *H01H 2227/022* (2013.01); *H01H 2227/036* (2013.01)

(58) Field of Classification Search
CPC ..... H01H 13/06; H01H 11/04; H01H 13/14; H01H 13/48; H01H 13/36; H01H 2013/525; H01H 2203/038; H01H 2205/03; H01H 2215/004; H01H 2223/002; H01H 2227/022; H01H 2227/036
See application file for complete search history.

(56) References Cited

U.S. PATENT DOCUMENTS 4,476,355 A * 10/1984 Mital ..... H01H 13/7006 200/275
6,462,960 B1 * 10/2002 Watanabe ..... H05K 9/0015 174/363

* cited by examiner

*Primary Examiner* — Anthony R Jimenez
(74) *Attorney, Agent, or Firm* — NSIP Law

(57) ABSTRACT

A waterproof board switch includes a print circuit board, a bottom coverlay, an insulation adhesive film having a dome hole and being thermo-compression bonded to the front surface of the print circuit board, a metal dome inserted into the dome hole, and a top coverlay coupled to the insulation adhesive film and the print circuit board to cover the dome hole and surround sides of the insulation adhesive film and sides of the print circuit board. The top coverlay is thermo-compression bonded to the top of the insulation adhesive film, the sides of the insulation adhesive film, and the sides of the print circuit board by thermo-compression bonding to seal a space on which the metal dome rests, thereby preventing an introduction of contaminant into the metal dome and the print circuit board.

7 Claims, 19 Drawing Sheets

B-B

C-C

WATERPROOF BOARD SWITCH AND METHOD OF MANUFACTURING WATERPROOF BOARD SWITCH

CROSS REFERANCE TO RELATED APPLICATIONS

This application is a U.S. national stage application of International Application No. PCT/KR2015/004526 filed on May 7, 2015, which claims the benefit of Korean Patent Application No. 10-2014-0055540 filed May 9, 2014, in the Korean Intellectual Property Office, the entire disclosures of which are incorporated herein by reference for all purposes.

TECHNICAL FIELD

The invention relates to a waterproof board switch and a method of manufacturing the switch and in particular, to a waterproof board switch which reduces the size of a tact switch and ensures a perfect waterproof structure and a method of manufacturing the same.

BACKGROUND ART

The tact switch is used to input an electrical signal or switch an electrical power between the terminals connected to a metal dome by arranging a conductive elastic contact or an elastic metal (referred to as 'metal dome') on a board having a pattern terminal and then by pressing and releasing the metal dome.

The tact switch is used for a keypad board such as a MP3 player, a MP4 player (video player), a mobile telecommunication terminal, a PDA, etc. or a print circuit board (PCB). The tact switch repeats either of the connection and the disconnection of an electrical signal or a power whenever a user pushes and releases the tact switch.

As mobile telecommunication and data processing devices such as a mobile telecommunication terminal, a PDA, etc. or a print circuit board are miniaturized and light-weighted, the tact switch is also required to be miniaturized.

Conventional tact switch has a size of about 4 mm×4 mm×0.5 mm (width×length×thickness). The tact switch is being made by a terminal-pattern PCB is prepared by consecutively printing switch terminals having the same pattern on epoxy board or phenol board (mostly, epoxy board is used), coating insulation material on portions except the terminal pattern, arranging a contact above the terminal pattern, covering with a dust cover, and cutting each PCB having the contact in a contact unit.

There is a rise in demand for the ultra-small tact switch having the minimized size of 2 mm×3 mm×0.5 mm (width×length×thickness) and due to the competition to reduce the thickness of the mobile devices, even the difference of a 0.1 mm width is required and thus, the reduction of the width of the tact switch even by the order of 0.1 mm is very important to reduce the thickness and weight of the mobile device.

FIG. 1 shows a cross section of a conventional tact switch 10. As shown in FIG. 1, the tact switch 10 comprises an insulation film 11, a print circuit board 12, a base 13, a metal dome 14 and a top coverlay 16. The top coverlay 16 is arranged on the base 13 such that it covers an inner space of the base 13 which receives the metal dome 13 therein.

If the size of the tact switch 10 becomes smaller, the size of the tact switch 10 depends on an expected bonding width $T_0$ of the bonding area of the top coverlay 16, thereby influencing waterproofness. That is, as shown in FIG. 1, if the outer rim of the top coverlay 16 is inaccurately in contact with the outer rim of the base 13, the outer rim of the top coverlay 16 is spaced apart from the outer rim of the base 13 the by the distance of $T_2$. In this case, the bonding width $T_1$ where the top coverlay 16 is in contact with the base 13 becomes smaller than the expected bonding width $T_0$ by the distance of $T_2$ and thus, the bonding width $T_1$ with regard to the top surface of the base 13 is smaller than the expected bonding width T0, thereby resulting in a poor bonding of the top coverlay 16.

When the top coverlay 16 is incompletely bonded to the base 13, the repetition of use of the tact switch 10 causes the incomplete bonding area of the top coverlay 16 with regard to the base 13 to be lifted.

If the tact switch 10 is repeatedly used, the conventional top coverlay 16 cannot perfectly seal the inner space of the based 13 on which the metal dome 14 rests and thus, the print circuit board 12 cannot be waterproof when water comes into electrical devices having the tact switch 10.

If moisture comes into the tact switch 10, a pop-up occurs such that an element located between the tact switch 10 and the print circuit board 12 becomes unfastened, thereby generating a deformation or crack of the element and decreasing a moisture sensitivity level (MSL).

It was very difficult to fasten the top coverlay 16 to the base 13 such that the arrangement of the outer rim of the top coverlay 16 to correspond to the outer rim of the base is made to a tolerance of 0.1 mm.

Further, as the tact switch 10 becomes smaller, the metal dome 14 also becomes smaller. If the size of the metal dome is reduced, the repetition of use of the tact switch 10 damages the metal dome 14, thereby reducing the lifetime of the metal dome 14. This impairs the reliability of the tact switch and in turn, restricts the reduction of the metal dome size.

Tact switch for mobile phone keypads is disclosed in Korean patent laid-open publication no. 10-2005-0014359.

DISCLOSURE OF THE INVENTION

Technical Problem

The invention is intended to solve the above problems and provides a reliable waterproof board switch and a method of manufacturing the same which prevents introduction of contaminants and/or water into the space between the contact portion of the print circuit board and the metal dome by sealing the area where the print circuit board and the metal dome are arranged, thereby preventing the malfunction or the error of electrical signal between the print circuit board and the metal dome.

Technical Solution

Preferably, a method of manufacturing a waterproof board switch according to the first embodiment comprises the following steps: (A) arranging a plurality of print circuit boards on a board plate, each of the print circuit board having a top pattern on a front surface and a bottom pattern on a rear surface; (B) insulating the rear surface of the print circuit board; (C) forming a board ass'y by thermo-compression bonding an insulation adhesive film having a dome hole to the front surface of the print circuit board; (D) forming a plurality of board holes near both edges of the dome hole on the board ass'y; (E) resting a metal dome on the dome hole such that the metal dome is able to be in contact with the top pattern; (F) arranging a top coverlay having bigger width than the insulation adhesive film on the board ass'y such that the top coverlay covers the dome hole; (G) arranging a thermoplastic resin above the top coverlay, arranging a top jig above the thermoplastic resin, arranging a bottom jig below the board ass'y and then applying thermo-compression to the thermoplastic resin by means of the top jig and the bottom jig; (H) making the thermoplastic resin having flowability flow from the top coverlay to the board hole by the step (G) such that ends of the top coverlay are bended so as to be in contact with sides of the board ass'y and then are inserted into the board hole, and then thermo-compression bonding the top coverlay to the top of the board ass'y and the sides of the board ass'y by means of the thermoplastic resin; and (I) separating the board ass'y to which the top coverlay was bonded from the board plate after the step (H).

In the first embodiment, it is preferable that at the step (G), a plate jig is arranged between the top coverlay and the thermoplastic resin so as to prevent the metal dome from being damaged by the thermoplastic resin having flowability at high temperature at the step (H).

In the first embodiment, it is preferable that the step (A) comprises the following steps: (A1) firstly etching a center contact portion of the top pattern on the front surface of the print circuit board; (A2) copper-plating the print circuit board after the step (A1); and (A3) secondly etching the front surface and the rear surface of the print circuit board after the step (A2) such that a center contact portion and a peripheral contact portion which constitute the top pattern are formed on the front surface of the print circuit board and a center contact terminal and a peripheral contact terminal which constitute the bottom pattern are formed on the rear surface of the print circuit board; wherein by the step (A3), the center contact portion is etched deeper than the peripheral contact portion by the thickness of the copper-plating such that the center contact portion is formed to have a step with regard to the peripheral contact portion on the front surface of the print circuit board.

In the first embodiment, it is preferable that t the step (H), the top coverlay covers the dome hole, ends of the top coverlay are arranged in the board hole, and the top coverlay is thermo-compression bonded to the board ass'y at the area except the rear surface of the board ass'y by the thermoplastic resin, thereby preventing the introduction of contaminant into the print circuit board and the metal dome.

In the first embodiment, it is preferable that at the step (H), the top coverlay covers the dome hole, ends of the top coverlay are arranged in the board hole, the top coverlay is thermo-compression bonded to the top surface, the sides and the rear surface of the board ass'y by the thermoplastic resin, thereby preventing the introduction of contaminant into the print circuit board and the metal dome.

In the first embodiment, it is preferable that between the step (E) and the step (F), a boss is installed between the metal dome and the top coverlay in the dome hole.

In the first embodiment, it is preferable that between the step (F) and the step (G), a boss is installed above the top coverlay.

Further, it is preferable that a waterproof board switch according to the preferred embodiment of the invention is manufactured by the method of manufacturing a waterproof board switch described above.

Also, a waterproof board switch according to the preferred embodiment comprises: a print circuit board comprising a top pattern having a center contact portion and a peripheral contact portion on a front surface and a bottom pattern having a central contact terminal and a peripheral contact terminal on a rear surface; a bottom coverlay arranged on the rear surface of the print circuit board to insulate the rear surface of the print circuit board; an insulation adhesive film configured to have a dome hole and configured to be thermo-compression bonded to the front surface of the print circuit board; a metal dome inserted into the dome hole to be able to be in contact with the top pattern; and a top coverlay coupled to the insulation adhesive film and the print circuit board so as to cover the dome hole and surround sides of the insulation adhesive film and sides of the print circuit board; wherein the top coverlay is thermo-compression bonded to the top of the insulation adhesive film, the sides of the insulation adhesive film and the sides of the print circuit board by thermo-compression bonding so as to seal a space on which the metal dome rests, thereby preventing the introduction of contaminant into the metal dome and the print circuit board.

In a preferred embodiment of the invention, a boss is further arranged between the metal dome and the top coverlay in the dome hole.

In a preferred embodiment of the invention, the insulation adhesive film has a dome hole of which the top and the bottom are open and one side of the dome hole is open.

In a preferred embodiment of the invention, the waterproof board switch comprises: a stem arranged to be able to be in contact with the top coverlay so as to push the top coverlay; a stem case having a stem seating hole on which the stem rests; and a cover having a stem through hole at one surface and a seating space on which the print circuit board and the stem case rest.

In a preferred embodiment of the invention, the top coverlay has a cross section in the form of ⊓.

In a preferred embodiment of the invention, the top coverlay is thermo-compression bonded to the top surface and the sides of the insulation adhesive film and the sides and the rear surface of the print circuit board so that the top coverlay seals a space on which the metal dome rests.

Advantageous Effect

According to the above features of the present invention, the top coverlay bonds the top and the sides of the insulation adhesive film as well as the sides of the board hole, and thus, the bonding area of the top coverlay and the insulation adhesive film and the bonding area of the top coverlay and the board hole are increased. Therefore, the invention can increase waterproofness for the dome hole on which the metal dome rests. Also, by the increase of contact area between the top coverlay and the insulation adhesive film, the process of assembling the top coverlay and the insulation adhesive film can be facilitated.

The invention minimizes the tact switch and ensures the perfect waterproofing structure by reducing the bonding width of the insulation adhesive film, since the top coverlay covers the top of the board ass'y where the metal dome rests and surrounds the sides of the board hole.

BEST MODE

Hereinafter, a waterproof board switch and a method of manufacturing the same according to preferred embodiments of to the invention will be explained in detail referring to the attached drawings.

First Embodiment

Hereinafter, referring to FIGS. 2 to 7*b*, a method of manufacturing the waterproof board switch according to a preferred embodiment of the invention will be explained.

Figure 3:
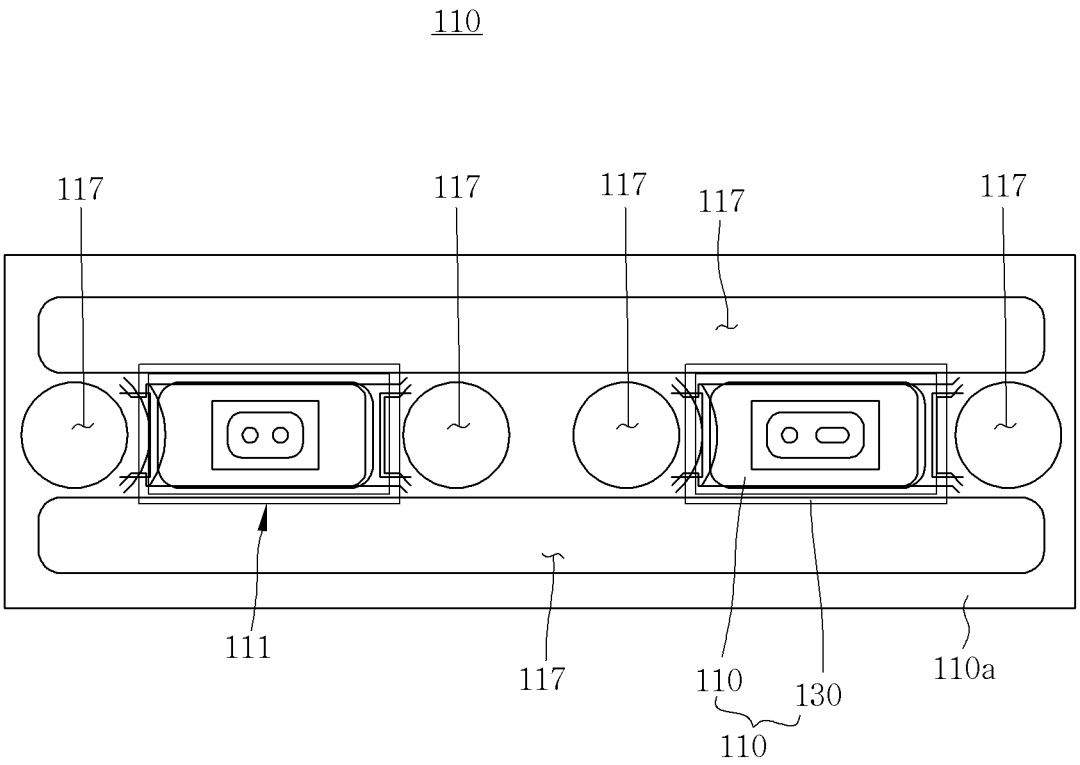
FIGS. 3 to 6 represent, in consecutive order, a process of a method of manufacturing a waterproof board switch according to the first embodiment.
Figure 4:
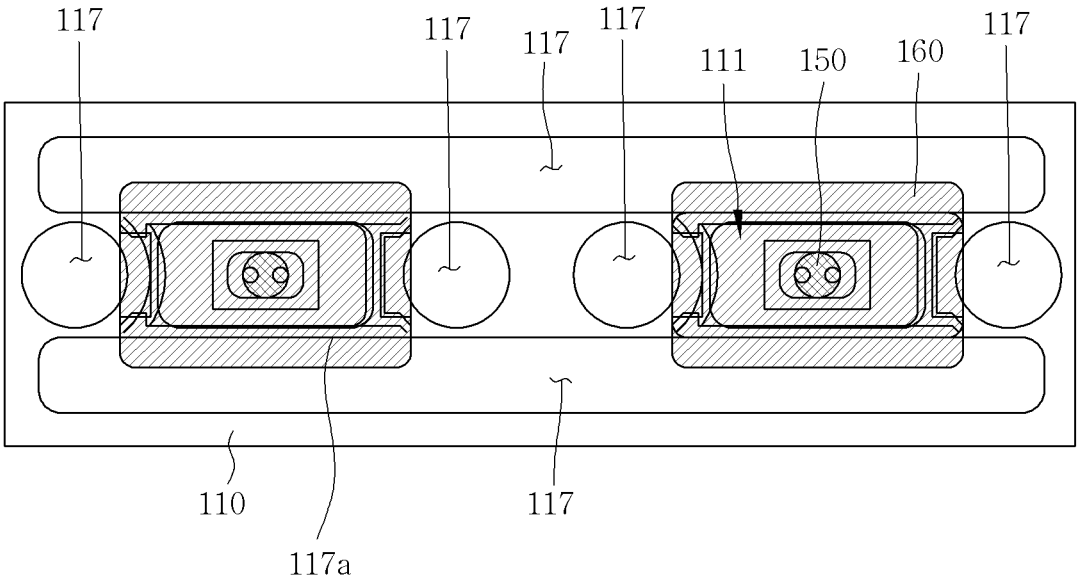

As shown in FIG. 3, a plurality of print circuit boards 111 are formed on a board plate 110*a* (step A). The plurality of print circuit boards 111 are spaced apart from each other at a predetermined distance. The board plate 110*a* is made of flexible material.

A top pattern is formed on a front surface of the print circuit board 111. The top pattern consists of a center contact portion 113 and a peripheral contact portion 114. A bottom pattern is formed on a rear surface of the print circuit board 111. The bottom pattern consists of a center contact terminal 115 and a peripheral contact terminal 116.

The print circuit board 111 is manufactured by the following method. First of all, the center contact portion 113 is firstly etched on the front surface of the print circuit board 111 (hereinafter referred to as first etching). Then, after the print circuit board 111 is copper-plated, the print circuit board is etched again (hereinafter referred to as second etching).

By the second etching, the center contact portion 113 and the peripheral contact portion 114 are formed on the front surface of the print circuit board 111 and the center contact terminal 115 and the peripheral contact terminal 116 are formed on the rear surface of the print circuit board 111. The center contact portion 113 is etched deeper than the peripheral contact portion 114 by the thickness of the copper plating by means of the second etching, whereby the center contact portion is formed on the front surface of the print circuit board 111 to have a step with regard to the peripheral contact portion 114.

Figure 11A:
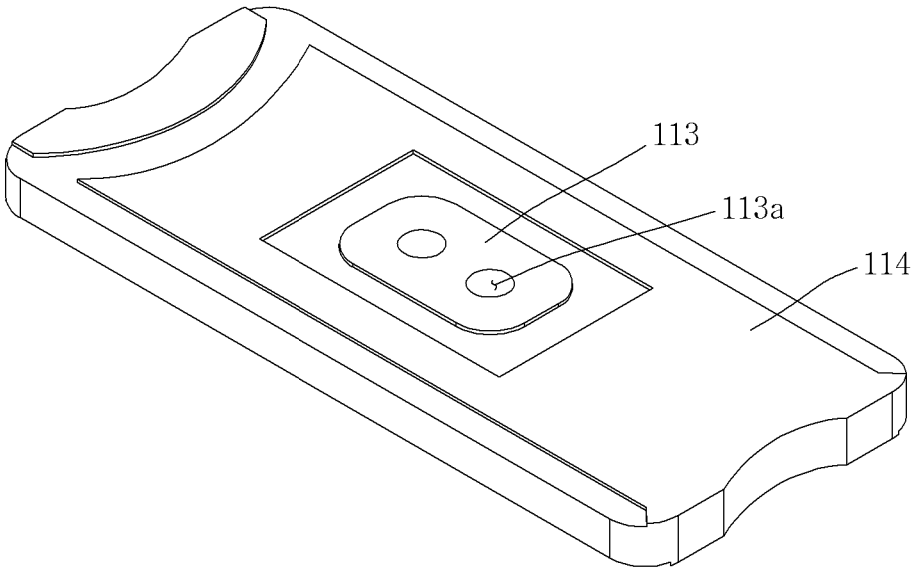
FIG. 11*a* schematically shows a perspective view of a print circuit board according to the first embodiment, FIG. 11*b* schematically shows a front surface of the print circuit board, and FIG. 11*c* schematically shows a rear surface of the print circuit board.
Figure 11B:
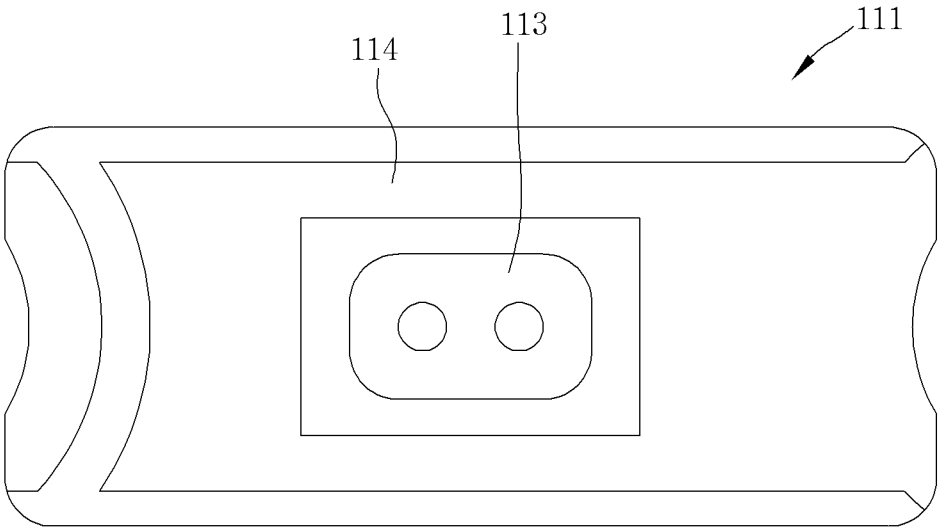
Figure 11C:
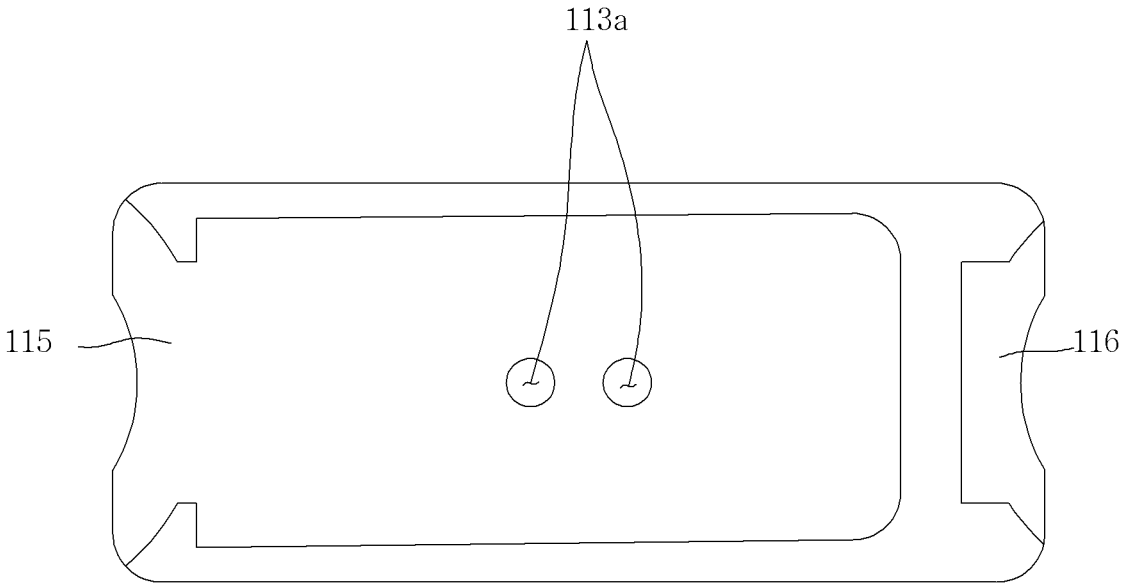

The print circuit board 111 manufactured by the above process is shown in FIGS. 11*a* to 11*c*. FIG. 11*a* shows a perspective view of the print circuit board 111, FIG. 11*b* schematically shows a front surface of the print circuit board 111, and FIG. 11*c* schematically shows a rear surface of the print circuit board 111.

As shown in FIGS. 11*a* and 11*b*, the center contact portion 113 is formed on the center of the front surface of the print circuit board 111. The center contact portion 113 is electrically connected to the center contact terminal 115 by a conduction hole 113*a* of the center contact portion.

The peripheral contact portion 114 is formed on the front surface of the print circuit board 111 such that it is shaped to surround the center contact portion 113. The peripheral contact portion 114 is configured to be electrically disconnected from the center contact portion 113. The peripheral contact portion 114 is electrically connected with the peripheral contact terminal 116. Here, the peripheral contact terminal 116 is arranged on the rear surface of the print circuit board 111 with being electrically disconnected from the center contact terminal 115.

At the step B, the rear surface of the print circuit board 111 is insulated by a bottom coverlay 120. The lower coverlay 120 is formed by applying thermosetting adhesive to the insulation film. The lower coverlay 120 is bonded to the rear surface of the print circuit board 111 by means of thermo-compression bonding such that the portions except the center contact terminal 115 and the peripheral contact terminal 116 are electrically insulated. For example, the lower coverlay 120 may be formed by the printing of insulation material Meanwhile, at the step C, an insulation adhesive film 130 having a dome hole 131 is thermo-compression bonded on the front surface of the print circuit board 111. By this process, a board ass'y 110 (PCB ASSY) is formed. In the example, the board ass'y 110 means a structure in which the lower coverlay 120 and the insulation adhesive film 130 are integrated with the print circuit board 111.

Here, the insulation adhesive film 130 is formed by applying thermosetting adhesive to the insulation film. A dome hole 131 is formed on the center of the insulation adhesive film 130. The dome hole 131 is a space into which a metal dome 140 is inserted.

At the step D, a plurality of board holes 117 are provided on the board ass'y 110. The board holes 117 are arranged near the edges of the dome hole 131 of the insulation adhesive film 130. The board holes 117 may be formed by die cutting which is press working or router operation. The board hole 117 is a space into which the ends 163, 164 of a top coverlay 160 which will be explained hereinafter are inserted.

At the step E, a metal dome 140 is inserted into the dome hole 131 to be able to in contact with the center contact portion 113 and rests on the front surface of the print circuit board 111.

The metal dome 140 is configured to have a center which protrudes in the shape of a dome. When an external force is applied, the metal dome 140 which rests in the dome hole 131 is in contact with the center contact portion 113 and is electrically connected to the center contact portion 113.

Figure 5A:
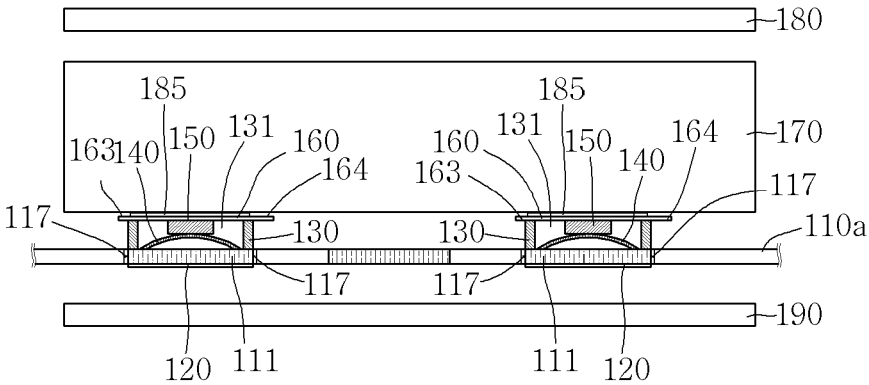
Figure 5B:
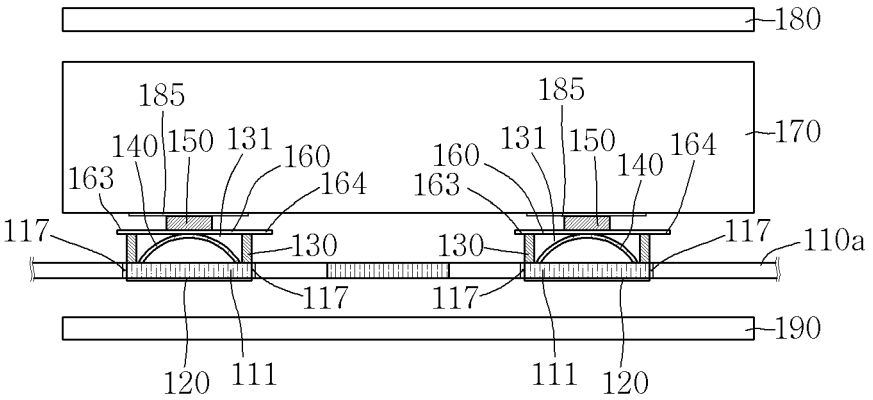
Figure 6:
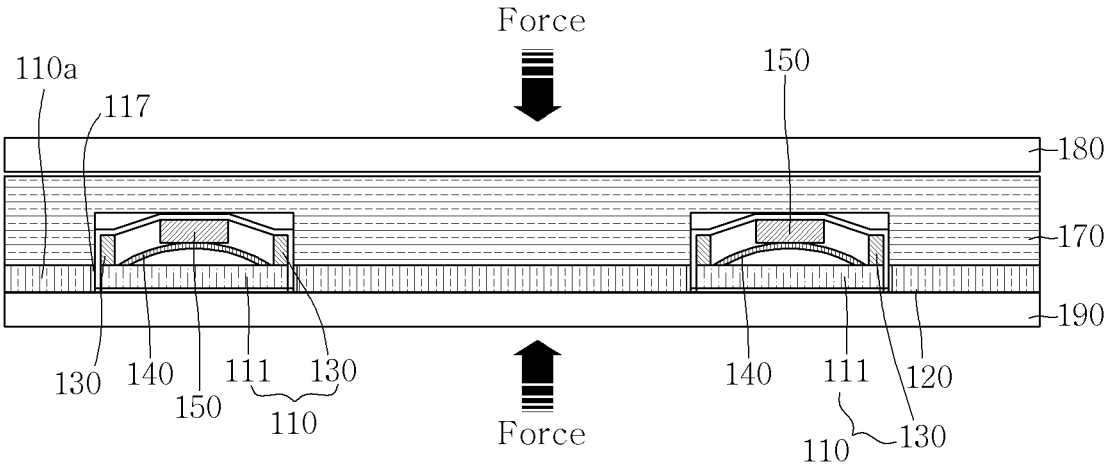

As can be seen in FIGS. 5*a* and 6, a boss 150 is located between the metal dome 140 and the top coverlay 160 and on the top center of the metal dome 140 and is fixed to the top coverlay 160 by thermo-compression bonding. Otherwise, the boss 150 may be thermo-compression bonded on the top of the top coverlay 160. Here, the boss 150 is a member made by applying thermosetting adhesive to the insulation film. The boss 150 is configured to press the metal dome 140 when an external force is applied.

At the step F, the top coverlay 160 is installed on the board ass'y 110 to cover the dome hole 131 of the insulation adhesive film 130. Here, the top coverlay 160 has a larger width than the insulation adhesive film 130.

In one example, preferably, the top coverlay 160 is made of material having high elasticity to prevent the breakaway or damage when the metal dome 140 is repeatedly pressed and high chemical properties including moisture tolerance.

Meanwhile, at the step G, a thermoplastic resin 170 is arranged on the top of the top coverlay 160. Then, a top jig 180 is arranged above the thermoplastic resin 170 and a bottom jig 190 is arranged under the board ass'y 110.

A plate jig 185 is arranged between the top coverlay 160 and the thermoplastic resin 170. The plate jig 185 is a jig which is bigger than the dome hole 131 and is thin. At the step H which is described hereinafter, during the thermo-compression bonding of the top jig 180 to the thermoplastic resin 170, the plate jig 185 prevents the metal dome from being damaged by the thermoplastic resin 170 which has high-temperature flowability.

According to the above steps in sequence, the top jig 180, the thermoplastic resin 170, the plate jig 185, the top coverlay 160 and the board ass'y 110 are arranged sequentially. Then, the top jig 180 and the bottom jig 190 apply heat and pressure to the thermoplastic resin 170.

At the step H, the thermoplastic resin 170 is plastically deformed by the thermo-compression bonding process of the top jig 180 to the thermoplastic resin 170 during the process of the step G, and the thermoplastic resin has flowability at high temperature. At this process, the board ass'y 110 and the top coverlay 160 are thermo-compression bonded by the high-temperature thermoplastic resin 170 having flowability.

At the step H, when the thermoplastic resin 170 having flowability at high temperature flows from the top coverlay 160 to the board hole 117, the ends 163, 164 of the top coverlay 160 are bended to be in contact with the sides of the board ass'y 110 and are inserted into the board hole 117. At this time, the thermoplastic resin 170 flows downwards along the outer surface of the top coverlay 160 and flows into the board hole 117, and thereafter the thermoplastic resin is cured so that the top coverlay 160 can be thermo-compression bonded to the board ass'y 110.

Here, the thermoplastic resin 170 becomes soft so as to flow when heated and becomes hardened when cooled. As the thermoplastic resin 170, polyethylene, polystyrene, polyethylene terephthalate, polyvinyl chloride, polyvinylidene chloride, etc. can be used and synthetic rubber can be also used.

Figure 7A:
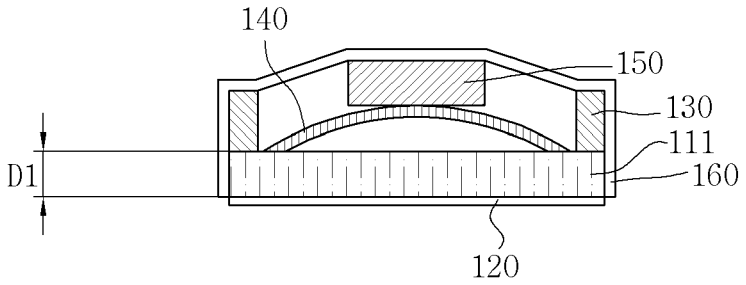
FIGS. 7*a* and 7*b* schematically show a cross section of a waterproof board switch manufactured by the method of manufacturing the switch according to the first embodiment.
Figure 7B:
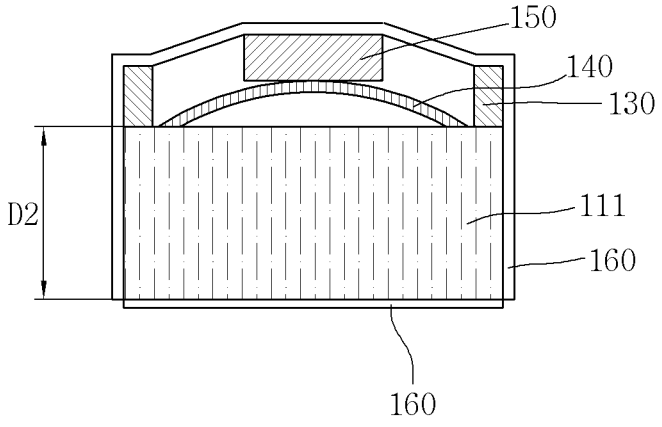

Bonding area of both ends 163, 164 of the top coverlay and the board ass'y 110 can be seen in FIGS. 7*a* and 7*b*. In case that the insulation adhesive film 130 has constant thickness, the bonding area of the top coverlay 160 to the print circuit board 111 becomes wider in proportion to the thickness of the print circuit board 111.

For example, as shown in FIG. 7*a*, if the thickness of the print circuit board 111 is D1 , the height of the side of the top coverlay 160 is the sum of the thickness D0 of the insulation adhesive film 130 and the thickness D1 of the print circuit board 111.

Meanwhile, as shown in FIG. 7*b*, if the thickness of the print circuit board 111 is D2, the height of the side of the top coverlay 160 is the sum of the thickness D0 of the insulation adhesive film 130 and the thickness D2 of the print circuit board 111. In case of D2>D1 , regarding the area of the top coverlay 160 which is in contact with the print circuit board 111, the contact area in FIG. 7*b* is larger than the contact area in FIG. 7*a*.

If the contact area of the top coverlay 160 and the board hole 117 becomes larger, the top coverlay 160 can seal the space between the board ass'y 110 and the metal dome 140, whereby ensuring the increase of waterproof efficiency of a waterproof board switch 100 which will be explained in the below.

If the top coverlay 160 is thermo-compression bonded to the board ass'y 110 by the above process, the plurality of the board assemblies 110 whose manufacturing process was completed are separated from the board plate 110*a* at the step I and the separation enables the supply of each single product.

The print circuit board 111 which went through the above manufacturing process is manufactured such that a plurality of the boards are arranged on the board plate 110*a* to have predetermined interval and size. Therefore, the process of separating each small print circuit board 111 from the board plate 110*a* follows. The separation of each small print circuit board 111 from a single board plate 110*a* is generally carried out by die cutting which is a press working.

Hereinafter, referring to FIGS. 8 to 11*c*, the waterproof board switch 100 according to the first embodiment of the invention will be described.

Figure 8:
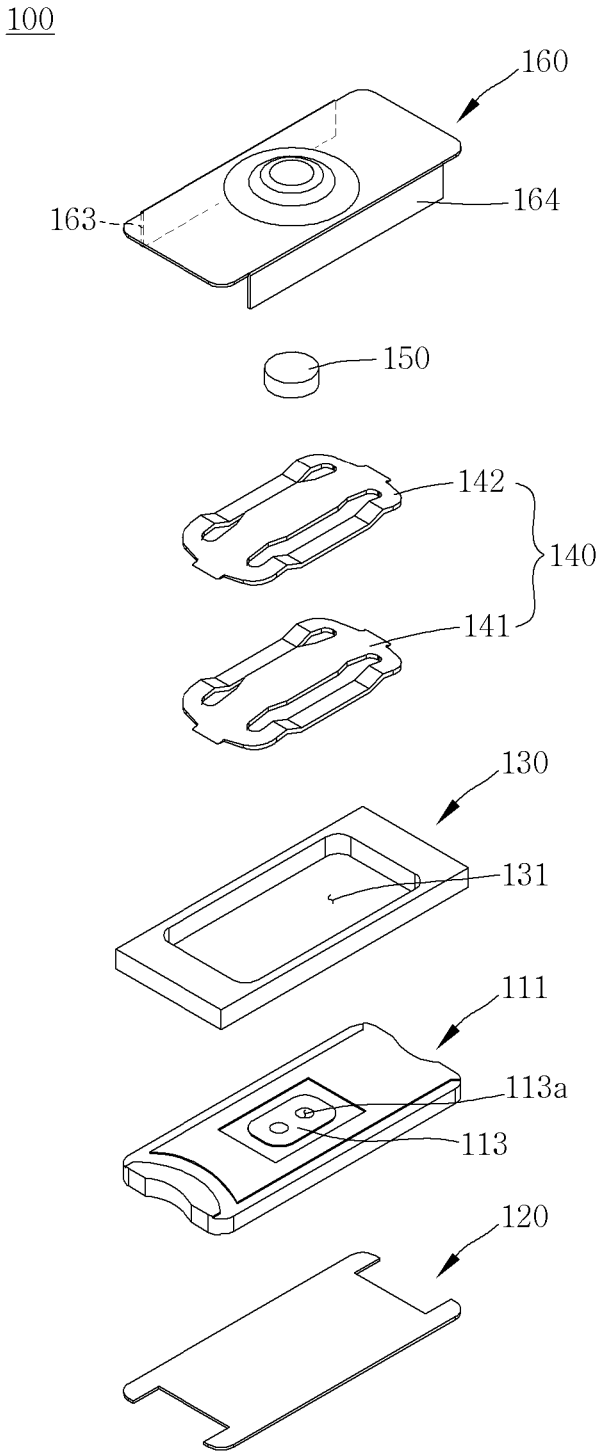
FIG. 8 schematically shows an exploded perspective view of a waterproof board switch according to the first embodiment.
Figure 10:
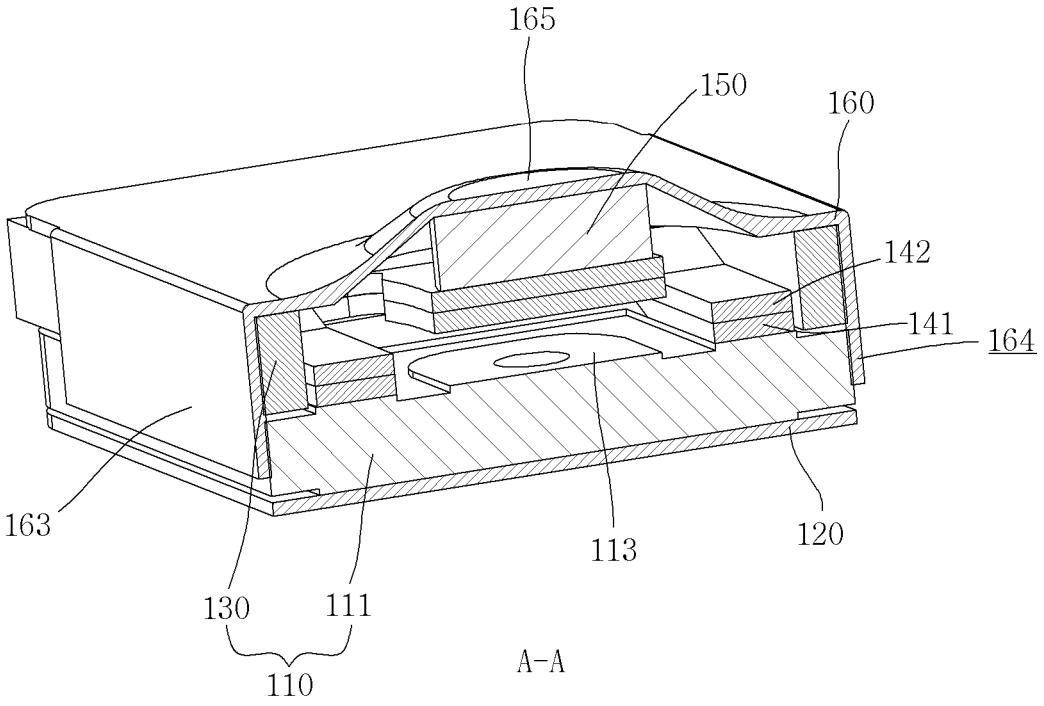
FIG. 10 schematically shows a waterproof board switch taken along a line A-A of FIG. 9.

As shown in FIGS. 8 and 10, the waterproof board switch 100 according to the first embodiment of the invention comprises a print circuit board 111, a bottom coverlay 120, an insulation adhesive film 130, a metal dome 140, a top coverlay 160 and a boss 150.

As shown in FIG. 11*a*, a center contact portion 113 and a peripheral contact portion 114 are formed on the front surface of the print circuit board 111. Here, the center contact portion 113 is electrically disconnected from the peripheral contact portion 114.

As shown in FIG. 11*c*, a center contact terminal 115 and a peripheral contact terminal 116 are formed on the rear surface of the print circuit board 111. The center contact terminal 115 is electrically connected to the center contact portion 113 and the peripheral contact terminal 116 is electrically connected to the peripheral contact portion 114.

As described above, the center contact portion 113 is formed on the center of the front surface of the print circuit board 111. The center contact portion 113 is electrically connected to the center contact terminal 115 via a conduction hole 113*a* of the center contact portion. The center contact terminal 115 is formed on the opposite surface of the flexible print circuit board 111 having the center contact portion 113 thereon.

As shown in FIGS. 11*a* and 11*b*, the peripheral contact portion 114 is formed on the front surface of the print circuit board 111 and is shaped to surround the center contact portion 113. The peripheral contact portion 114 is configured to be electrically disconnected from the center contact portion 113. The peripheral contact portion 114 is electrically connected to the peripheral contact terminal 116. Here, the peripheral contact terminal 116 is arranged on the rear surface of the print circuit board 111 and is configured to be disconnected from the center contact terminal 115.

Figure 9:
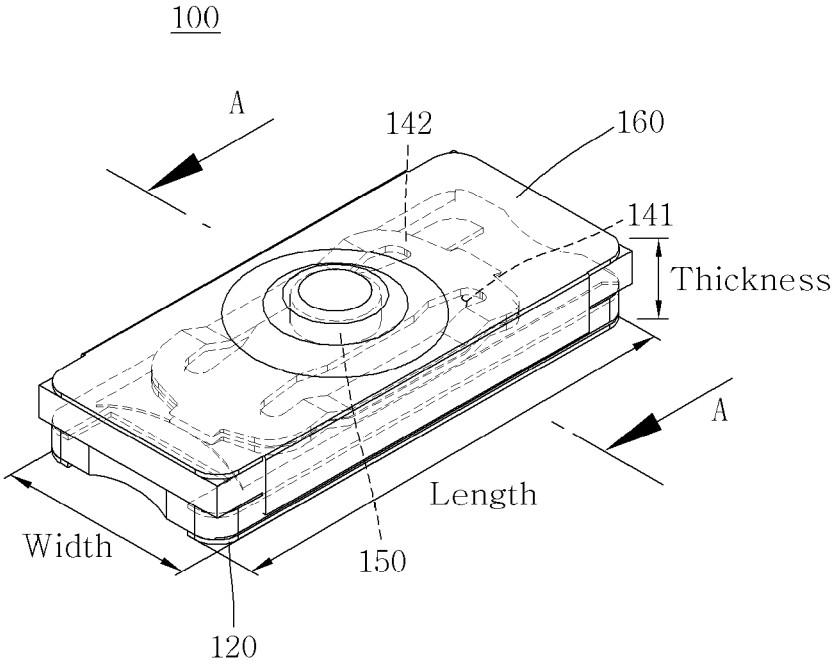
FIG. 9 schematically shows an assembled perspective view of a waterproof board switch according to the first embodiment.

As shown in FIGS. 8 to 10, the bottom coverlay 120 is contactably arranged on the rear surface of the print circuit board 111. The bottom coverlay 120 is a kind of an insulation film and is thermo-compression bonded to the rear surface of the print circuit board 111 so as to insulate the rear surface of the print circuit board 111 in such a manner that the portions except the center contact terminal 115 and the peripheral contact terminal 116 are electrically insulated, thereby insulating the rear.

In the example, the bottom coverlay 120 serves to prevent an outer contaminant or water from being introduced into the print circuit board 111. The bottom coverlay 120 is an insulation film to which thermoplastic adhesive is applied.

As shown in FIGS. 8 to 10, the insulation adhesive film 130 is bonded to the front surface of the print circuit board 111. The insulation adhesive film 130 has a ring structure having a dome hole 131 on the center. After the insulation adhesive film 130 is attached to the front surface of the print circuit board 111, a metal dome 140 is inserted into the dome hole 131.

As shown in FIG. 8, the metal dome 140 is configured to have a protrusion of a dome shape whose center is convex. This structure is intended to maintain an elasticity of the metal dome 140.

The metal dome 140 is made by coating a high-conductivity metal such as Au onto a high-elasticity metal sheet such as stainless steel and then by punching the metal sheet by a press to be shaped such that the sheet can return upwardly to the initial position after being pushed.

The waterproof board switch 100 according to the embodiment may have a plurality of metal domes 140 to receive greater force. In the example, for explanatory purposes, the metal dome configured to be in contact with the center contact portion 113 of the print circuit board 111 will be referred to as "first metal dome 141" and the metal dome configured to be stacked on the first metal dome 141 will be referred to as "second metal dome 142". In the example, for explanatory purposes, the metal domes installed on the board ass'y 110 will be two metal domes, but the number of them is not limited thereto.

The waterproof board switch 100 according to the embodiment uses a plurality of metal domes to increase the force applied by the metal dome 140 to the board ass'y 110. Also, in the waterproof board switch 100 according to the first embodiment, the plurality of the metal domes 140 can partially overcome the lifetime limit of the metal dome 140 due to the miniaturization of the metal dome 140 as the tact switch becomes smaller.

Preferably, as shown in FIG. 10, the top coverlay 160 covers the top of the insulation adhesive film 130 and surrounds the sides of the print circuit board 111. For example, the top coverlay 160 according to the embodiment has a cross section in the form of ⊓ as shown in FIG. 10. The top coverlay 160 is configured to fully cover the space defined by the dome hole 131 such that the introduction of the contaminant or water into the dome hole 131 can be prevented.

Therefore, the waterproof board switch 100 according to the first embodiment prevents the malfunction or the error of electrical signal due to the connection error between the metal dome and the print circuit board, thereby ensuring the ultra-thin waterproof and dustproof structure with more reliability.

Advantageously, in the first embodiment, the top coverlay 160 is made of material having high elasticity to prevent the breakaway or damage when the metal dome 140 is repeatedly pressed and high chemical properties including moisture tolerance.

As shown in FIGS. 8 and 10, the boss 150 is arranged between the top coverlay 160 and the second metal dome 142. In particular, the boss 150 is arranged between the pressing area of the top coverlay 160 and the upper surface of the second metal dome 142. The boss 150 is thermo-compression bonded to the bottom surface of the top coverlay 160. The boss 150 presses the second metal dome 142 by the force applied to the pressing area of the top coverlay 160. In the embodiment, the pressing area of the top coverlay 160 refers to the area where the metal dome is pushed when the metal dome is pressed by an external force such that the metal dome 140 can make contact with the center contact portion 113.

The waterproof board switch 100 according to the first embodiment is configured such that the top coverlay 160 fully covers the top of the board ass'y 110 and surrounds the sides of the board ass'y 110, thereby preventing the introduction of the contaminant or water into the dome hole 131.

Therefore, the malfunction or the error of electrical signal due to the connection error between the metal dome and the print circuit board, which occurs by the introduction of the contaminant or water into the dome hole 131, can be prevented, thereby ensuring the ultra-thin waterproof and dustproof structure with more reliability.

Second Embodiment

Hereinafter, referring to FIGS. 12 to 16, the waterproof board switch and the method of manufacturing the same according to the second embodiment of the invention will be explained.

Figure 1:
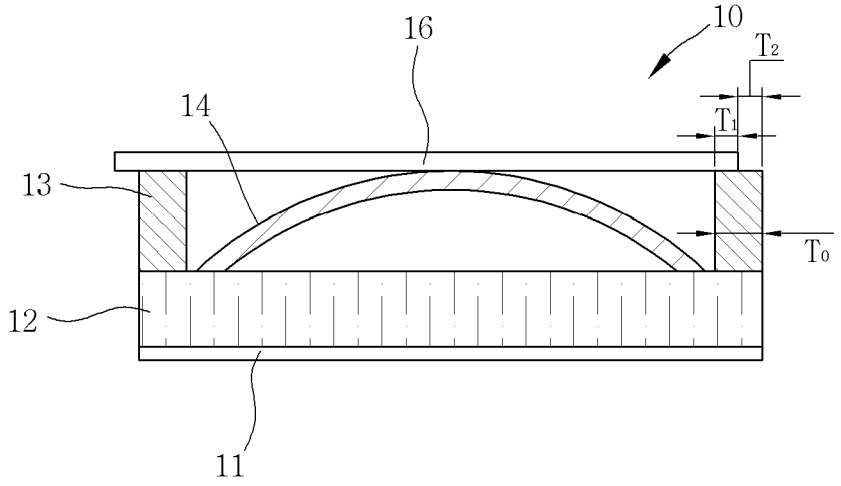
FIG. 1 schematically shows a cross section of a tact switch according to a conventional technique.
Figure 2:
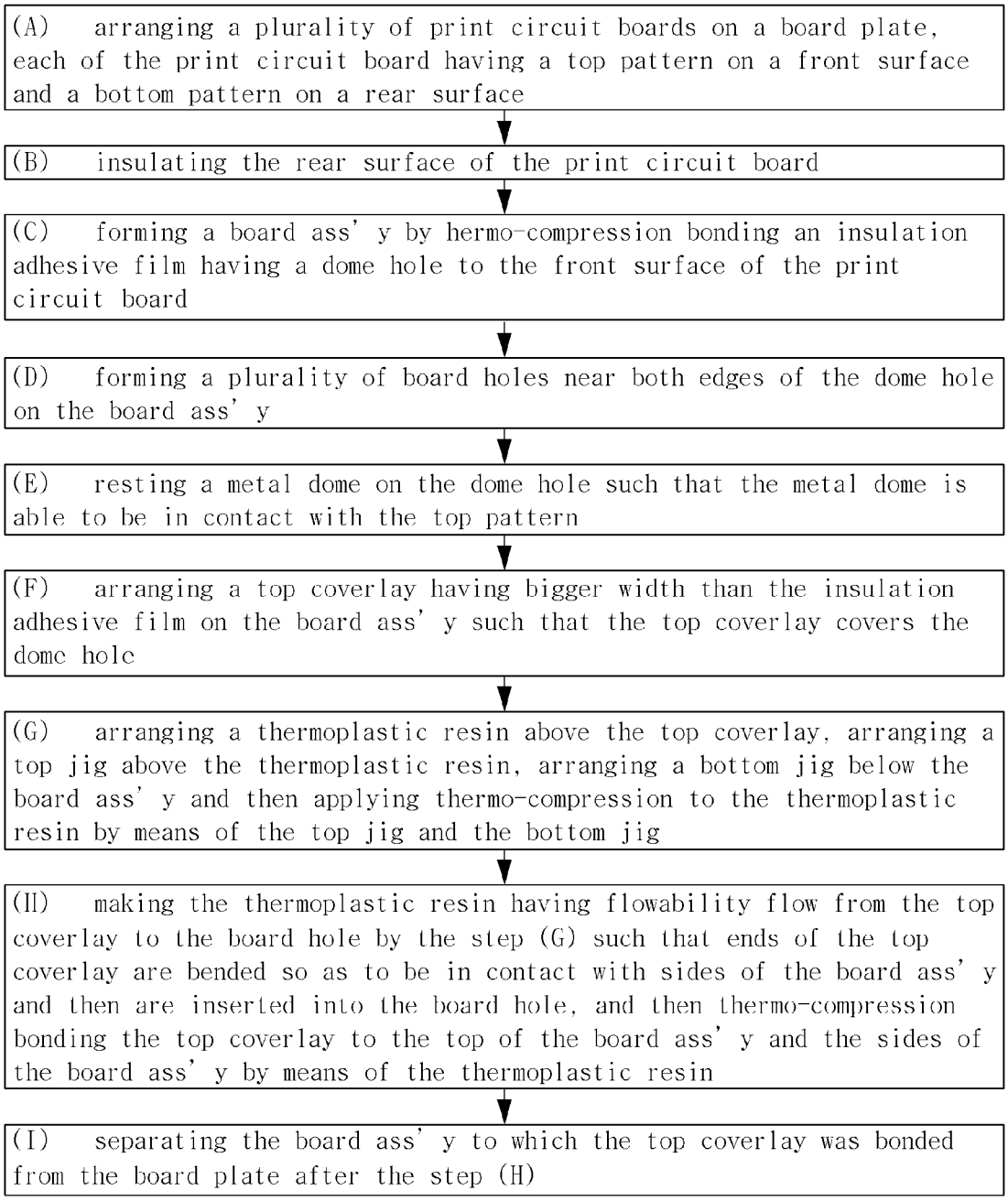
FIG. 2 schematically shows a flow chart of a method of manufacturing a waterproof board switch according to the first embodiment.

The method of manufacturing the waterproof board switch according to the second embodiment is carried out according to the flow as shown in FIG. 2 in the same way as the first embodiment. However, the method of manufacturing the waterproof board switch according to the second embodiment uses a top coverlay 160*a* which has bigger width than the top coverlay 160 of the first embodiment, an insulation adhesive film 130*a* having different structure from the insulation adhesive film 130 of the first embodiment, and a bottom jig 190*a* having different structure from the bottom jig 190 of the first embodiment. Here, the insulation adhesive film 130*a*, the top coverlay 160*a* and the bottom jig 190*a* will be described later.

Meanwhile, in this embodiment, to avoid the repetition of explanations, the board plate 110*a*, the structure and shape of the print circuit board 111, the bottom coverlay 120, the metal dome 140, the boss 150, the thermoplastic resin 170 and the top jig 180 which have the same structure and function as the first embodiment will not be described.

Figure 12:
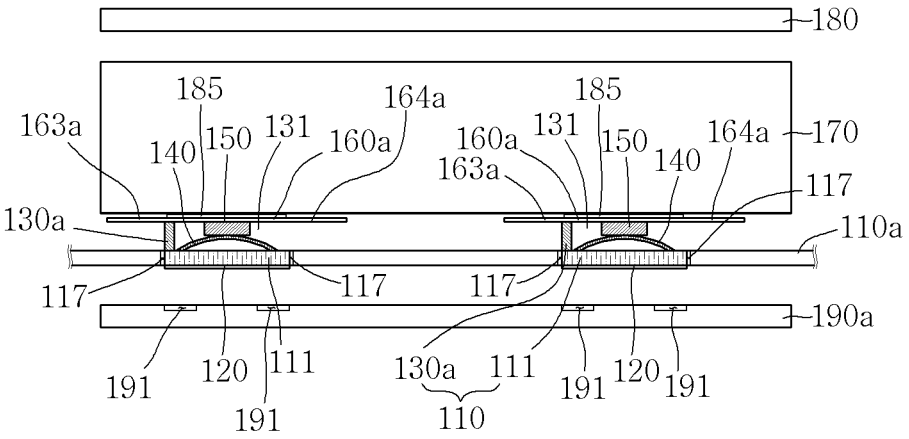
FIG. 12 schematically represents a process of a method of manufacturing a waterproof board switch according to the second embodiment.

As shown in FIG. 12, in the process of manufacturing the waterproof board switch, the top coverlay 160*a* is arranged on the board ass'y 110 to cover the dome hole 131*a* of the insulation adhesive film 130*a*. Here, the top coverlay 160*a* has a larger width than the insulation adhesive film 130*a*. The top coverlay 160*a* has a larger width than the top coverlay 160 of the first embodiment. This structure is intended for making the heat-contact possible up to the rear surface of the bottom coverlay 120.

Then, the thermoplastic resin 170 is arranged on the top of the top coverlay 160*a*. The top jig 180 is arranged above the thermoplastic resin 170. The bottom jig 190*a* is arranged under the board ass'y 110. Groove 191 is formed on the top of the bottom jig 190*a*. Here, the ends 163*a*, 164*a* of the top coverlay are inserted into the groove 191 and the groove 191 is a space configured such that the ends 163*a*, 164*a* of the top coverlay are thermo-compression bonded to the rear surface of the bottom coverlay 120 during the thermo-compression process which will be explained below.

The plate jig 185 is arranged between the top coverlay 106*a* and the thermoplastic resin 170. Here, the plate jig 185 has a bigger size than the dome hole 131*a* and has a smaller thickness than the dome hole 131*a*. The plate jig 185 prevents the thermoplastic resin 170 from damaging the metal dome when the top jig 180 applies heat and pressure to the thermoplastic resin 170.

In order as explained in the above, the top jig 180, the thermoplastic resin 170, the plate jig 185, the top coverlay 160*a* and the board ass'y 110 are arranged sequentially, and then the top jig 180 and the bottom jig 190*a* apply heat and pressure to the thermoplastic resin 170.

The thermoplastic resin 170 is plastically deformed by the thermo-compression process of the top jig 180 to the thermoplastic resin 170 and then flows at high temperature. During this process, the board ass'y 110 and the top coverlay 160*a* are thermo-compression bonded by the thermoplastic resin 170 having high temperature flowability.

When the thermoplastic resin 170 having flowability at high temperature flows from the top coverlay 160*a* into the board hole 117, the ends 163*a*, 164*a* of the top coverlay 160*a* are bended to be in contact with the sides of the board ass'y 110 and are inserted into the board hole 117 and then are inserted into the groove 191 formed on the bottom jig 190*a*. At this time, the thermoplastic resin 170 flows downwards along the outer surface of the top coverlay 160*a* and flows into the board hole 117, and thereafter the thermoplastic resin is cured so that the top coverlay 160*a* can be thermo-compression bonded to the board ass'y 110.

The thermoplastic resin 170 becomes soft so as to flow when heated and becomes hardened when cooled. As thermoplastic resin 170, plastic such as polyethylene, polystyrene, polyethylene terephthalate, polyvinyl chloride, polyvinylidene chloride, etc. can be used, and synthetic rubber can be also used.

Figure 13:
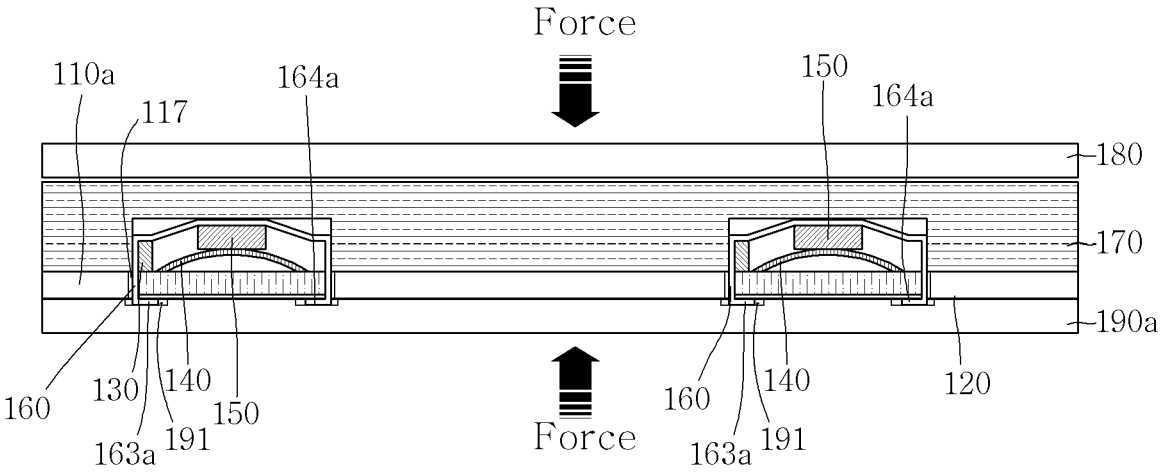
FIG. 13 schematically shows a cross section of a waterproof board switch manufactured by the method of manufacturing the switch according to the second embodiment.

Bonding area of both ends 163*a*, 164*a* of the top coverlay 160*a* and the board ass'y 110 can be seen in FIG. 13. In case that the insulation adhesive film 130*a* has constant thickness, the bonding area of the top coverlay 160*a* with regard to the print circuit board 111 becomes wider in proportion to the thickness of the print circuit board 111.

Since the top coverlay 160*a* according to this embodiment is in contact with the sides of the insulation adhesive film 130*a* and the sides of the print circuit board 111 and is also in contact with the rear surface of the bottom coverlay 120, the area in contact with the board hole 117 is increased, thereby increasing the waterproof efficiency of the waterproof board switch 100*a*.

Hereinafter, referring to FIGS. 14 to 16, the waterproof board switch 100*a* according to the second embodiment will be explained.

As explained in the above, the waterproof board switch 100*a* according to the second embodiment of the invention comprises a print circuit board 111, a bottom coverlay 120, an insulation adhesive film 130*a*, a metal dome 140, a top coverlay 160*a* and a boss 150.

In this embodiment, to avoid the repetition of explanations, the board plate 110*a*, the structure and shape of the print circuit board 111, the bottom coverlay 120, the metal dome 140, the boss 150, the thermoplastic resin 170 and the top jig 180 which have the same structure and function as the first embodiment will not be described. Hereinafter, the insulation adhesive film 130*a* and the top coverlay 160*a* which have different structure from the first embodiment will be described.

Figure 14:
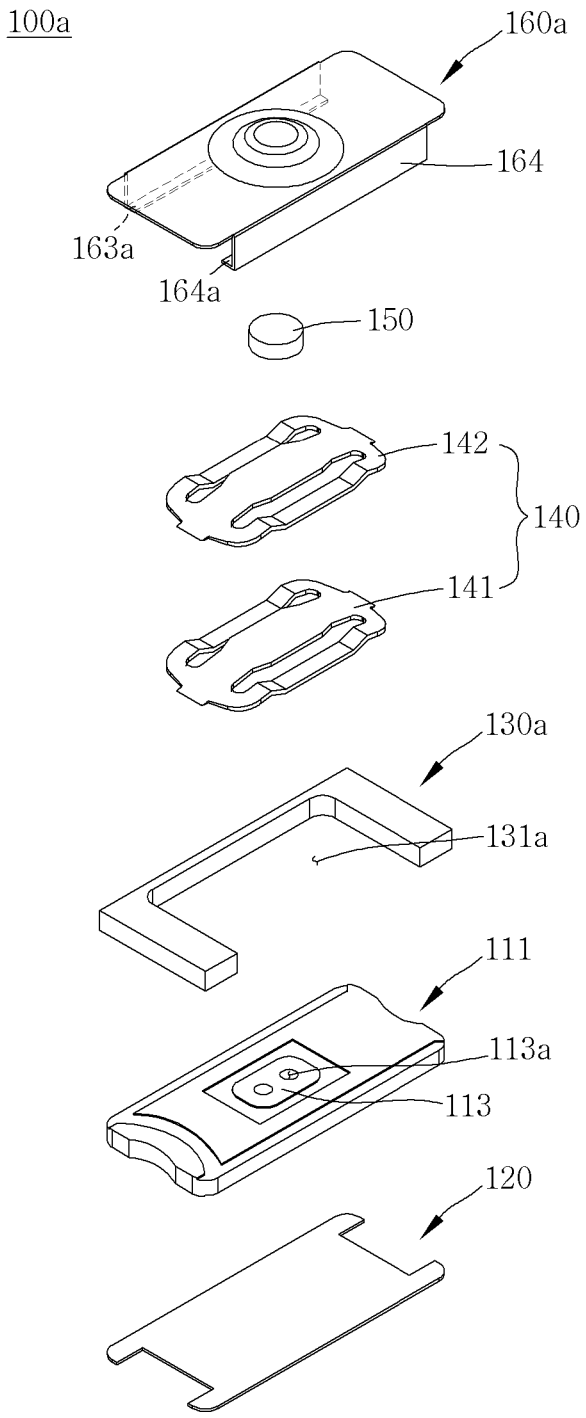
FIG. 14 schematically shows an exploded perspective view of a waterproof board switch according to the second embodiment.
Figure 15:
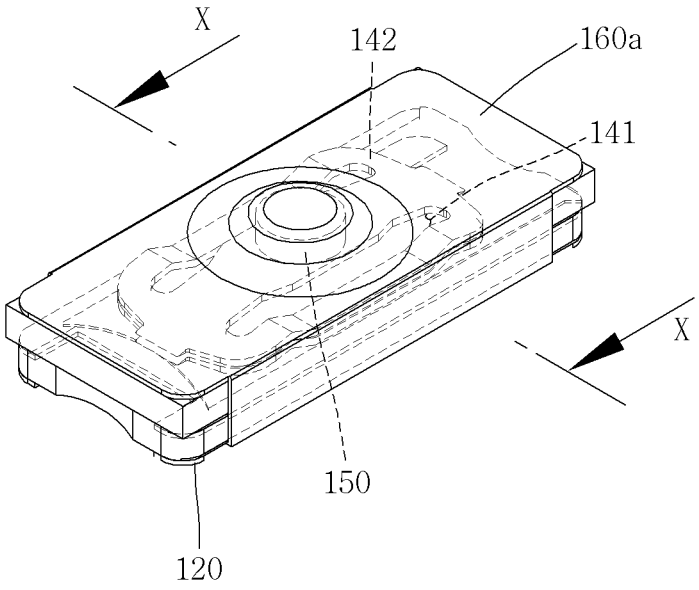
FIG. 15 schematically shows an assembled perspective view of a waterproof board switch according to the second embodiment.

As shown in FIGS. 12 to 16, the insulation adhesive film 130*a* is bonded to the front surface of the print circuit board 111. The insulation adhesive film 130*a* has a dome hole 131*a* at the center. As can be seen in FIG. 14, the dome hole 131*a* has an open top and an open bottom. Also, one side of the dome hole 131*a* is open. Such a structure is intended for easy insertion of the metal dome 140 into the dome hole 131*a* when a wide metal dome 140 is used.

After the insulation adhesive film 130*a* is bonded to the front surface of the print circuit board 111, the metal dome 140 is installed in the dome hole 131*a*.

Figure 16:
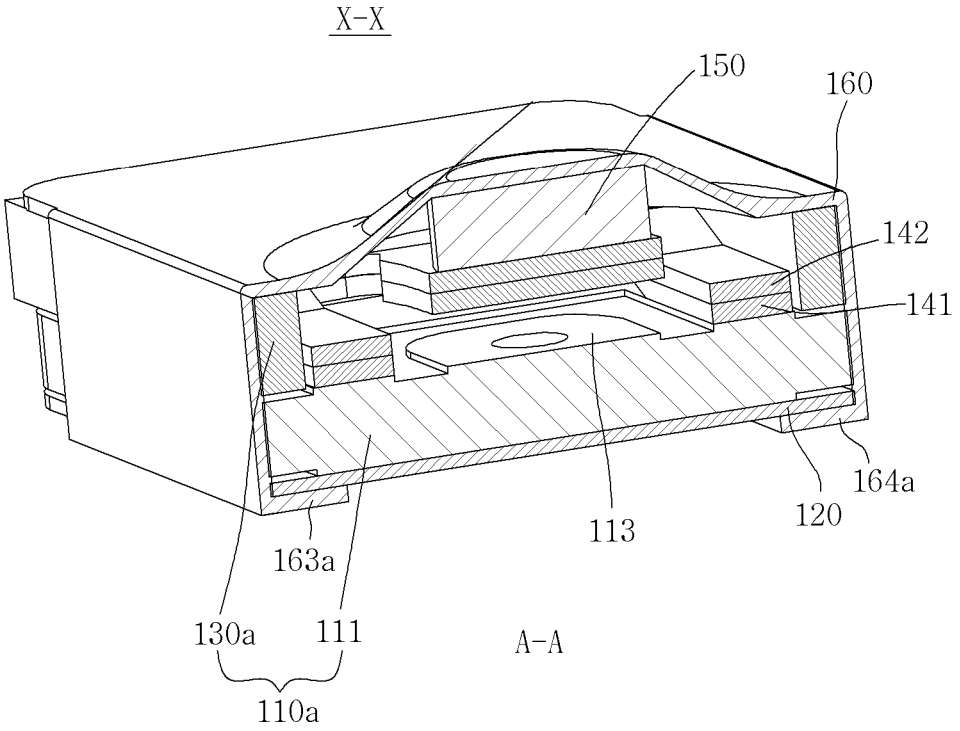
FIG. 16 schematically shows a cross-section of a waterproof board switch taken along a line X-X of FIG. 15.

Meanwhile, as shown in FIGS. 14 and 16, the top coverlay 160*a* covers the top of the insulation adhesive film 130*a* and surrounds the sides of the insulation adhesive film 130*a*, the sides of the print circuit board 111 and some portion of the rear surface of the bottom coverlay 120. For example, the top coverlay 160*a* according to the embodiment has a cross section in the form of ⊏⊐.

The top coverlay 160*a* is configured to fully cover the space defined by the dome hole 131*a* such that the introduction of the contaminant or water into the center contact portion 113 and the peripheral contact portion 114 which are electrically connected/disconnected by the metal dome 140 can be prevented.

Therefore, the waterproof board switch 100*a* according to the second embodiment prevents the malfunction or the error of electrical signal due to the connection error between the metal dome and the print circuit board, caused by the contaminant or water introduced into the dome hole, thereby ensuring the ultra-thin waterproof and dustproof structure with more reliability.

Advantageously, in the this embodiment, the top coverlay 160*a* is made of material having high elasticity to prevent the breakaway or damage when the metal dome 140 is repeatedly pressed or high chemical properties including moisture tolerance.

The waterproof board switch 100*a* according to the embodiment is configured such that the top coverlay 160*a* covers the top of the board ass'y 110 and surrounds the sides of the board ass'y 110, thereby preventing the malfunction or the error of electrical signal due to the introduction of the contaminant or water into the dome hole 131*a* and in turn, ensuring the ultra-thin waterproof and dustproof structure with more reliability.

Third Embodiment

Hereinafter, referring to FIGS. 17 to 20, the waterproof board switch 200 according to the third embodiment of the invention will be explained.

As shown in FIGS. 17 to 20, the waterproof board switch 200 according to the third embodiment of the invention comprises a print circuit board 211, a bottom coverlay 220, an insulation adhesive film 230, a metal dome 240, a top coverlay 260, a stem 270, a stem case 280 and a cover 290.

The board ass'y 210 is manufactured by the same method as the board ass'y 110 of the first embodiment. The board ass'y 210 comprises a print circuit board 211 and an insulation adhesive film 230.

The shape and the structure of the print circuit board 211 are the same as the embodiments explained in the above and therefore, to avoid the repetition of explanations, the print circuit board plate 211 will not be described.

As shown in FIGS. 17 to 20, the bottom coverlay 220 is bonded to the rear surface of the print circuit board 211. The bottom coverlay 220 is a kind of an insulation film and is thermo-compression bonded to the rear surface of the print circuit board 211 so as to insulate the rear surface of the print circuit board 211 in such a manner that the portions except a center contact terminal 215 and a peripheral contact terminal 216 are electrically insulated.

In the embodiment, the bottom coverlay 220 prevents the introduction of an outer contaminant or water into the print circuit board 211. In the embodiment, the bottom coverlay 220 is installed on a seating portion of the cover 290 while being attached to the rear surface of the print circuit board 211.

As shown in FIGS. 17 to 20, the insulation adhesive film 230 is bonded to the front surface of the print circuit board 211. The insulation adhesive film 230 has a ring structure having a dome hole 231 at the center. After the insulation adhesive film 230 is attached to the front surface of the print circuit board 211, a metal dome 240 is installed in the dome hole 231.

Figure 17:
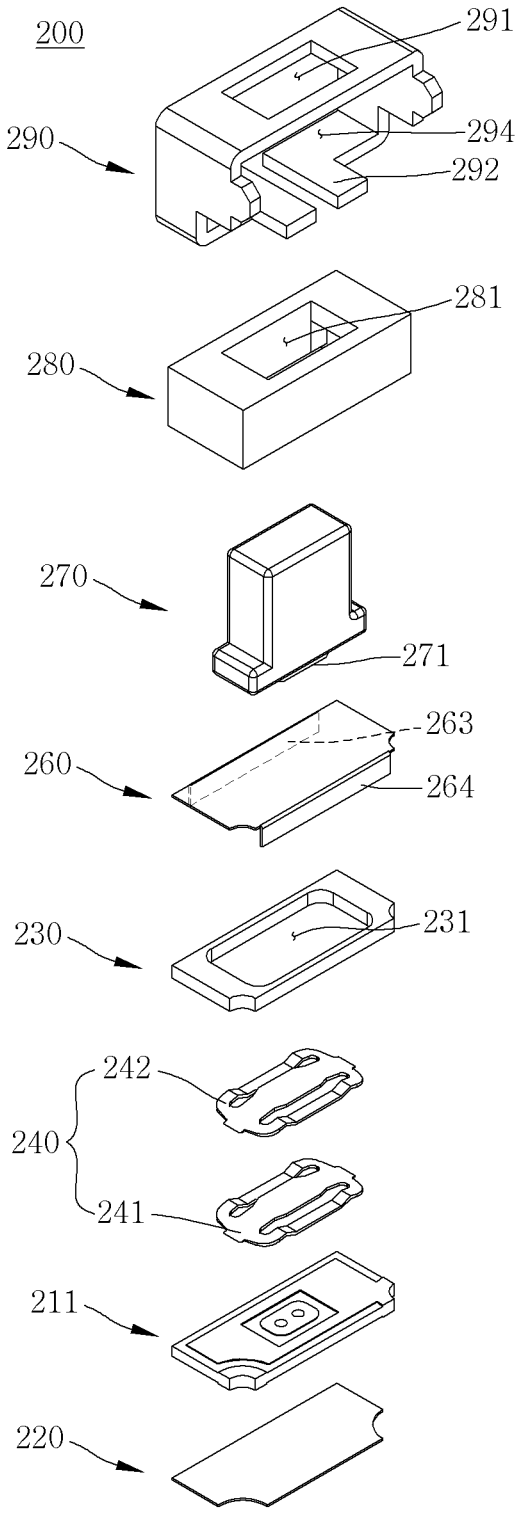
FIG. 17 schematically shows an exploded perspective view of a waterproof board switch according to the third embodiment.

As shown in FIG. 17, the metal dome 240 is configured to have the center protrude in the shape of a dome. Since the structure, shape and material are the same as the embodiments described in the above, to avoid the repetition of the explanations, the metal dome 240 will not be described in detail.

As described in the embodiments in the above, a first metal dome 241 is arranged on the front surface of the print circuit board 211 in the dome hole 231 such that the first metal dome is spaced apart from a center contact portion. A second metal dome 242 is arranged between the first metal dome 241 and the top coverlay 260.

Figure 19:
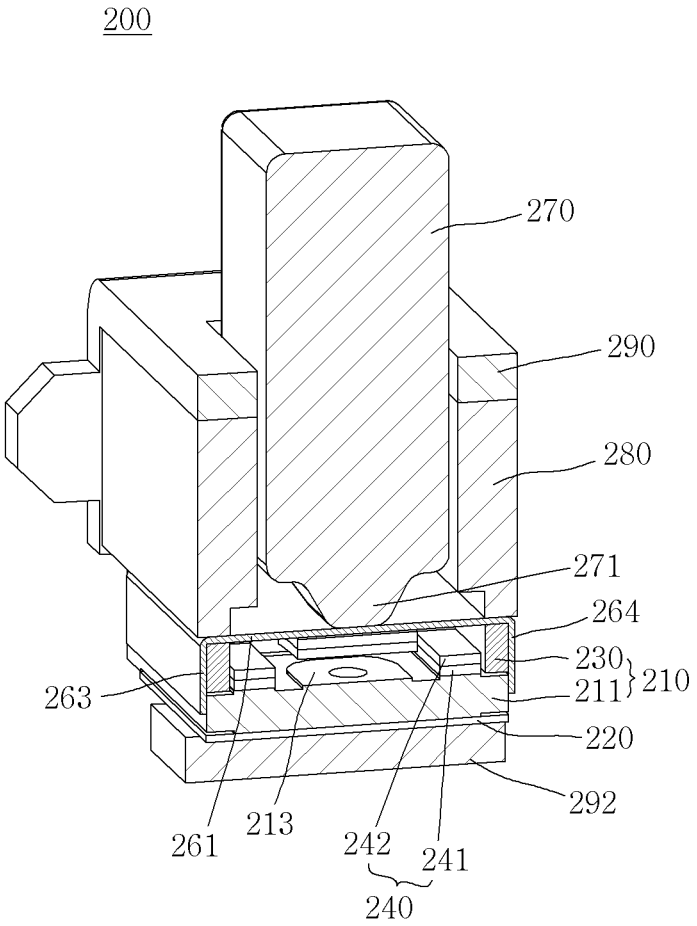
FIG. 19 schematically shows a cross-section of a waterproof board switch taken along a line B-B of FIG. 18.

Preferably, in the embodiment, as shown in FIG. 19, the top coverlay 260 is configured such that the top 261 of the top coverlay covers the dome hole 231 of the insulation adhesive film 230 and the sides 263, 264 of the top coverlay cover the sides of the insulation adhesive film 230 and the sides of the print circuit board 211. Preferably, the top coverlay 260 according to the embodiment has a cross section in the form of ⊓ as shown in FIG. 19.

The top coverlay 260 is configured such that it fully covers the space defined by the dome hole 231 between the insulation adhesive film 230 and the print circuit board 211, thereby preventing the introduction of the contaminant or water into the the center contact portion 213 and the peripheral contact portion 214 which are connected/disconnected by the metal dome 240.

Therefore, the waterproof board switch 200 according to the third embodiment prevents the malfunction or the error of electrical signal due to the contaminant or water, ensuring the ultra-thin waterproof and dustproof structure with more reliability.

Preferably, in the third embodiment, the top coverlay 260 is made of material having high elasticity to prevent the breakaway or damage when the metal dome 240 is repeatedly pressed by means of the stem 270 and high chemical properties including moisture tolerance.

As shown in FIG. 19, the stem 270 is arranged in a receiving space 281 formed inside the stem case 280 and pushes the metal dome 240 when an external force is applied. As shown in FIGS. 17 and 19, a protrusion 271 whose center is protruded is formed at one end of the stem 270. When an external force is applied, the protrusion 271 of the stem presses the center of the metal dome 240.

The stem 270 is arranged such that the other end of the stem 270 is protruded outwards. Therefore, a user can push the stem 270 easily.

When the stem 270 pushes the metal dome 240 by an external force, the metal dome 240 is elastically straightened and becomes in contact with the center contact portion 213 such that it is electrically connected to the center contact portion 213. For the waterproof board switch 200, when the metal dome 240 is in contact with the center contact portion 213, the center contact portion 213 is electrically in contact with the peripheral contact portion 214 so that the center contact terminal 215 and the peripheral contact terminal 216 becomes to be in an electrically conducting state.

The stem 270 pushes the metal dome 240 by an external force and returns back to the initial position by the elasticity of the metal dome 240 when the external force is released.

Figure 18:
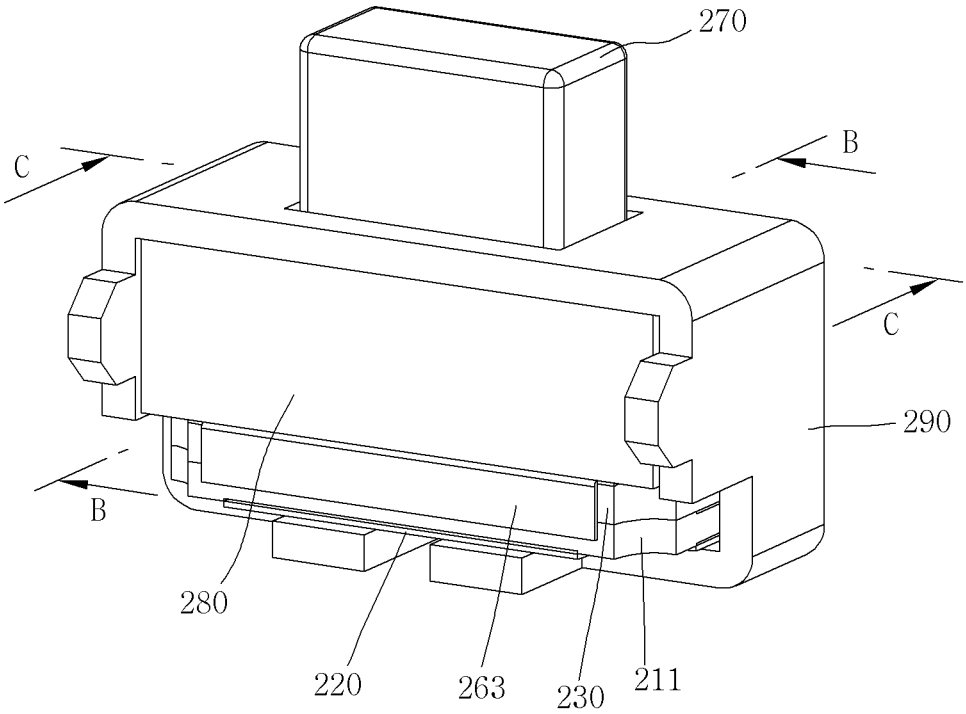
FIG. 18 schematically shows an assembled perspective view of a waterproof board switch according to the third embodiment.
Figure 20:
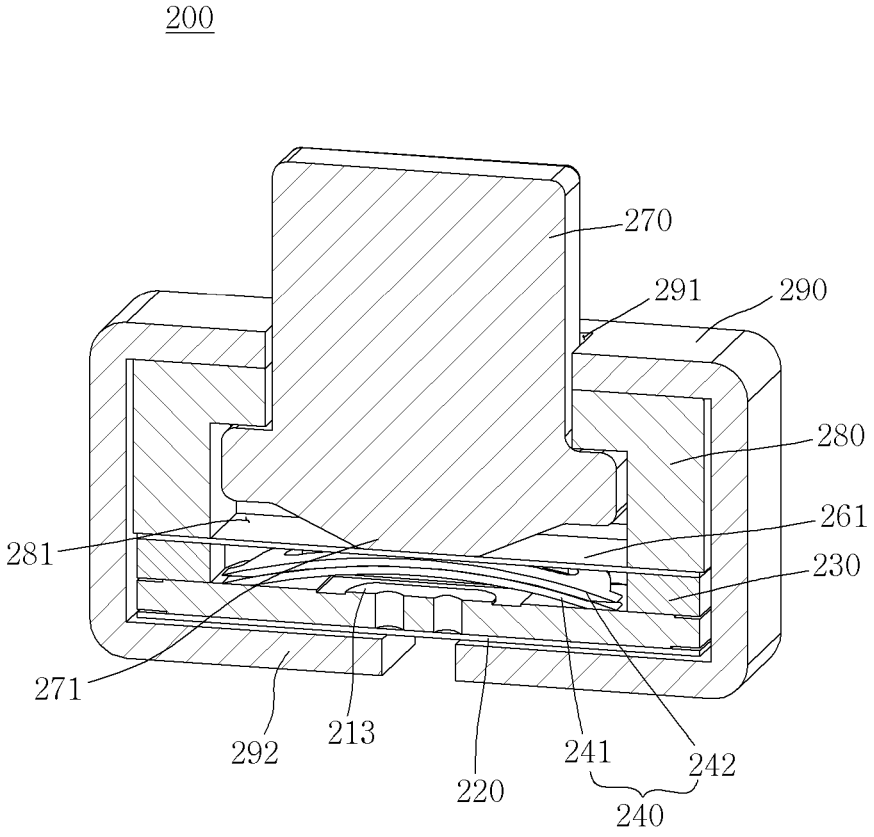
FIG. 20 schematically shows a cross-section of a waterproof board switch taken along a line C-C of FIG. 18.

As shown in FIGS. 18 to 20, the stem case 280 is arranged above the top coverlay 260. The stem case 280 is a member to guide the stem 270. The stem case 280 has a receiving space 281 which receives the stem 270 therein.

Here, preferably, the receiving space 281 of the stem case 280 is of the dimensions such that it guides the stem 270 while the stem 270 is being maintained not to be inclined to one side. In the embodiment, the stem case 280 is coupled to the print circuit board 211 by the cover 290.

As shown in FIGS. 18 to 20, the cover 290 is a member to fix the print circuit board 211 to which the top coverlay 260 and the bottom coverlay 220 are bonded and the stem case 280. As shown in FIG. 17, it is preferable that the cover 290 has a shape of a square box. Preferably, both sides of the cover 290 having the box shape are open.

A stem through hole 291 through which the stem 270 penetrate is formed on the front surface of the stem 290. A seating portion 292 is arranged on the bottom of the cover 290. Here, the bottom coverlay 220 bonded to the rear surface of the print circuit board 211 is arranged on the seating portion 292.

The stem case 280 is arranged on the front surface 261 of the top coverlay 260 bonded to the board ass'y 210. The stem case 280 is arranged such that it pushes the rim of the top coverlay 260. The stem case 280 is fixed in an inner space 294 of the cover 290 between the top coverlay 260 and the front surface of the cover 290.

As shown in FIGS. 18 to 20, when the stem case 280 engages with the cover 290, the stem 270 is installed such that the other end of the stem 270 penetrate the stem through hole 291 and protrudes outwards from the front surface of the cover 290.

The waterproof board switch 200 according to the embodiment is configured such that the top coverlay 260 fully covers the top of the print circuit board 211, thereby preventing the malfunction or the error of electrical signal due to the introduction of the contaminant or water into the print circuit board 211 and in turn, ensuring the ultra-thin waterproof and dustproof structure with more reliability.

Also, the waterproof board switch 200 can stack the metal domes to increase the operating force by the stacked structure of the first metal dome 241 and the second metal dome 242. Therefore, the waterproof board switch 200 according to the third embodiment of the invention can overcome the lifetime limit of the metal dome 240 due to the miniaturization of the metal dome 240 as the waterproof board switch becomes smaller.

As above, the invention was described based on the embodiments of the invention. It is obvious that those skilled in the art can embody variations within the scope which does not depart from the essential technical spirit of the invention. Therefore, the embodiments are intended to describe the invention, not to limit the invention. That is, the technical scope of the invention is within the claims and all the difference within the equivalent to the invention are embraced within the invention.

The invention claimed is:

1. A waterproof board switch comprising:

a print circuit board comprising a top pattern having a center contact portion and a peripheral contact portion on a front surface and a bottom pattern having a central contact terminal and a peripheral contact terminal on a rear surface;

a bottom coverlay arranged on the rear surface of the print circuit board to insulate the rear surface of the print circuit board;

an insulation adhesive film having a dome hole and being thermo-compression bonded to the front surface of the print circuit board;

a metal dome inserted into the dome hole to be in contact with the top pattern; and a top coverlay coupled to the insulation adhesive film and the print circuit board so as to cover the dome hole and surround sides of the insulation adhesive film and sides of the print circuit board;

wherein the top coverlay is thermo-compression bonded to a top surface of the insulation adhesive film, the sides of the insulation adhesive film and the sides of the print circuit board by thermo-compression bonding so as to seal a space on which the metal dome rests, thereby preventing an introduction of contaminant between the metal dome and the print circuit board.

2. The waterproof board switch according to claim 1, wherein a boss is arranged between the metal dome and the top coverlay in the dome hole.

3. The waterproof board switch according to claim 1, comprising:

a stem arranged to be in contact with the top coverlay so as to push the top coverlay;

a stem case having a stem seating hole on which the stem rests; and a cover having a stem through hole at one surface and a seating space on which the print circuit board and the stem case rest.

4. The waterproof board switch according to claim 1, wherein the top coverlay is thermo-compression bonded to the rear surface of the print circuit board.

5. A waterproof board switch, comprising:

a print circuit board (PCB) comprising top and bottom patterns, the top pattern having central and peripheral contact portions on a front surface, and the bottom pattern having central and peripheral contact terminals on a rear surface;

a bottom coverlay arranged on the rear surface of the PCB to insulate the rear surface of the PCB;

an insulation adhesive film having a dome hole and thermo-compression bonded to the front surface of the PCB;

a metal dome in the dome hole; and a top coverlay being thermo-compression bonded to a top surface and sides of the insulation adhesive film and sides of the PCB so as to cover the dome hole and surround the sides of the insulation adhesive film and the PCB, thereby preventing an introduction of contaminant between the metal dome and the PCB.

6. The waterproof board switch according to claim 5, further comprising a boss arranged between the metal dome and the top coverlay in the dome hole, wherein the dome hole is formed at a center portion of the insulation adhesive film.

7. The waterproof board switch according to claim 5, further comprising:

a stem arranged to be in contact with the top coverlay so as to push the top coverlay;

a stem case having a stem seating hole on which the stem rests; and a cover having a stem through hole at one surface and a seating space on which the print circuit board and the stem case rest.

* * * * *